United States Patent [19]

Yahata

[11] Patent Number: 4,783,795

[45] Date of Patent: Nov. 8, 1988

[54] X-RAY GENERATOR SYSTEM

[75] Inventor: Mitsuru Yahata, Otawara, Japan

[73] Assignee: Kabushikigaisha Toshiba, Kanagawa, Japan

[21] Appl. No.: 7,482

[22] Filed: Jan. 28, 1987

[30] Foreign Application Priority Data

Feb. 18, 1986 [JP] Japan ..... 61-33551

[51] Int. Cl.[4] ..... H05G 1/20

[52] U.S. Cl. ..... 378/105; 378/4; 378/15; 378/106; 378/114; 323/266; 363/24; 363/25; 363/26; 363/97

[58] Field of Search ..... 378/4, 101, 106, 114, 378/15, 105; 363/24–26, 97; 323/266

[56] References Cited

U.S. PATENT DOCUMENTS 4,030,015 6/1977 Herko et al. ..... 323/266
4,170,734 10/1979 Woodruff ..... 378/107
4,200,795 4/1980 Kawamura et al. ..... 378/101
4,223,378 9/1980 Koizumi ..... 363/26
4,255,668 3/1981 Harrison ..... 307/107
4,514,795 4/1985 Van der Zwart ..... 378/101

*Primary Examiner*—Craig E. Church
*Assistant Examiner*—John C. Freeman
*Attorney, Agent, or Firm*—Finnegan, Henderson Farabow, Garrett and Dunner

[57] ABSTRACT

An X-ray generator system has first and second switching devices such as transistors which are complementarily turned on and off to intermittently apply a DC voltage to the primary winding of a transformer for thereby inducing a high voltage across secondary windings of the transformer for enabling an X-ray tube to emit X-rays. The X-ray generator has a control mode in which the first and second switching devices are simultaneously turned on immediately before they start being complementarily turned on and off, for allowing the high voltage to have a sharply rising positive-going edge.

3 Claims, 3 Drawing Sheets

X-RAY GENERATOR SYSTEM

BACKGROUND OF THE INVENTION

The present invention relates to an X-ray generator system for generating X-rays.

Some X-ray generator systems employ a high-frequency inverter for producing a high voltage (tube voltage) to be applied between the anode and the filament of an X-ray tube. Since the high-frequency inverter has good response, the X-ray generator systems can generate pulsed X-ray radiation without using a tetrode.

The conventional X-ray generator systems with such an inverter are however disadvantageous in that the positive-going edge of the tube voltage fails to rise sharply because of the inductances of a transformer and a reactor. It has been desired that the rising characteristics of the tube voltage be improved since they affect the rising characteristics of X-rays and hence information borne by the X-ray that has passed through an object.

SUMMARY OF THE INVENTION

In view of the aforesaid drawback of the conventional X-ray generator systems, it is an object of the present invention to provide an X-ray generator system in which a tube voltage applied to generate X-rays has good rising characteristics or a sharply rising positive-going edge for stable X-ray radiation.

According to the present invention, the above object can be achieved by an X-ray generator system comprising an inverter having a transformer with primary and secondary windings and first and second switching devices coupled to opposite ends of said primary winding, for generating a high voltage across said secondary winding for the generation of X-rays in response to intermittent application of a DC voltage to said primary winding by complementarily turning on and off said first and second switching devices, means for generating X-rays in response to said high voltage produced across said secondary winding, and an inverter controller for controlling the complementary turning-on and turning-off of said first and second switching devices, said inerter controller having a control mode for simultaneously turning on said first and second switching devices immediately before the first and second switching devices are complementarily turned on and off.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
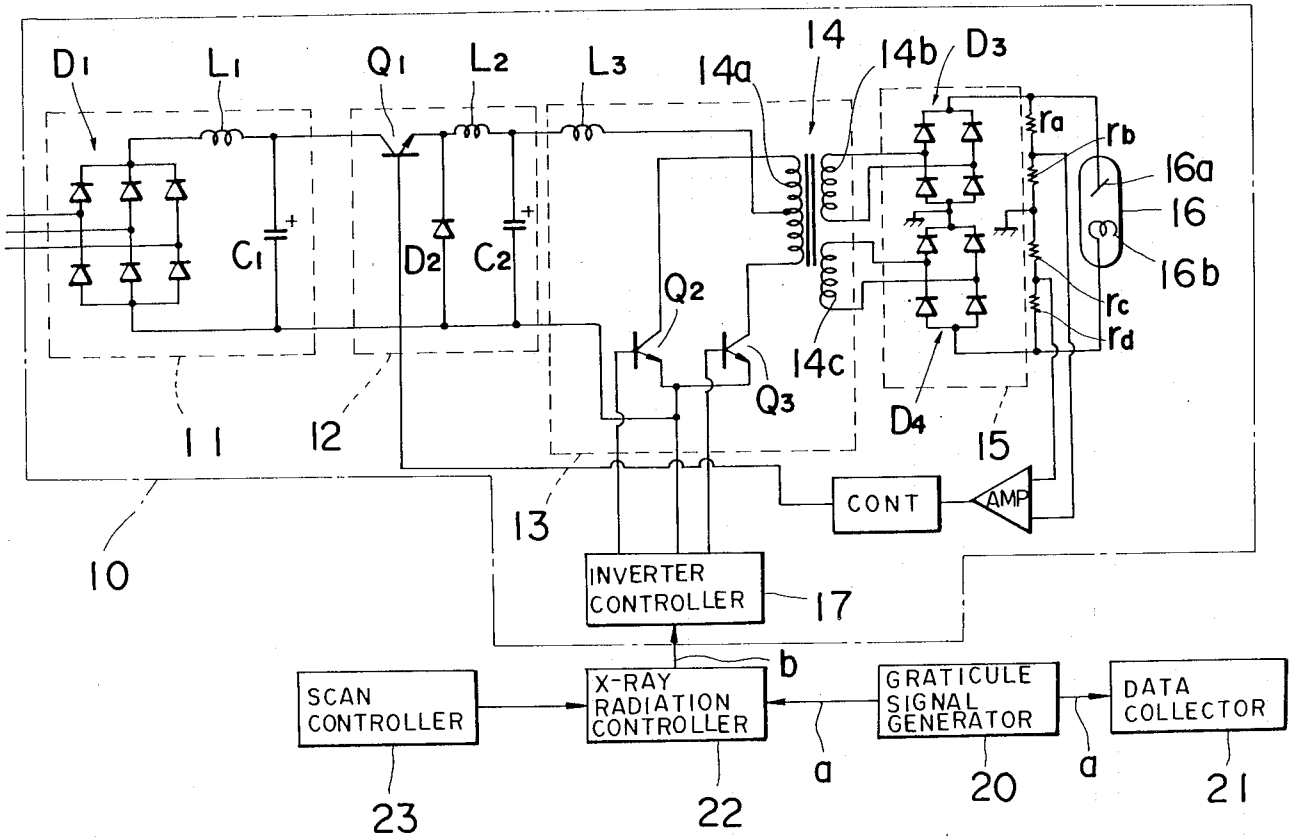
FIG. 1 is a circuit diagram, partly in block form, of an X-ray generator system according to the present invention, as incorporated in an X-ray CT (computerized tomography) scanning apparatus.

FIG. 1 shows an X-ray generator system according to the present invention, as incorporated in an X-ray CT scanning apparatus. The X-ray generator system, generally designated by the reference numeral 10, has a first rectifying and smoothing circuit 11, a DC voltage regulator 12, an inverter 13, a second rectifying and smoothing circuit 15, an X-ray tube 16, and an inverter controller 17.

The first rectifying and smoothing circuit 11 which serves to rectify and smooth applied three-phase AC voltages has a three-phase bridge rectifier D1 for rectifying the applied voltages, and a coil L1 and a capacitor C1 for smoothing out a rectified DC output voltage. The DC voltage regulator 12 for regulating the DC output voltage from the rectifying and smoothing circuit 11 is in the form of a chopper circuit having a switching transistor O1, a freewheeling diode D2, a coil L2, and a capacitor $C_2$.

The inverter 13 comprises a coil L3 connected at one end to a positive output terminal of the DC voltage regulator 12, a transformer 14 having a primary winding 14*a* with its central tap coupled to the other end of the coil L3, and first and second switching means comprising transistors Q2, Q3, respectively, having collectors joined to the opposite eds of the primary winding 14*a* of the transformer 14 and emitters joined to a negative output terminal of the DC voltage regulator 12. The aforesaid circuit arrangement of the inverter 13 is known as a so-called push-pull inverter circuit, which intermittently applies a DC voltage to the transformer primary winding 14*a* for inducing high AC voltages across secondary windings 14*b*, 14*c* of the transformer 14 in response to complementary conduction of the transistors Q2, Q3, i.e., alternate energization and de-energization of the transistors Q2, Q3.

The second rectifying and smoothing circuit 15 serves to rectify and smooth the output voltages from the inverter 13, and includes two bridge rectifiers D3, D4 that are connected in series with each other. The bridge rectifiers D3, D4 have terminals coupled to an anode 16*a* and a filament 16*b* of the X-ray tube 16. The common junction of the bridge rectifiers D3, D4 are connected to ground.

The inverter controller 17 controls the switching operation of the transistors Q2, Q3 of the inverter 13. In the X-ray generator system 10, the inverter controller 17 has a control mode to simultaneously turn on the transistors Q2, Q3 immediately before they start to be complementarily turned on and off. Various arrangements would be possible for achieving such a control mode. In the illustrated embodiment, the inverter controller 17 generates a radiation preparation signal based on a first X-ray radiation signal among repetitive pulsed X-ray radiation signals b supplied from an X-ray radiation controller 22. The inverter controller 17 first turns on the transistors Q2, Q3 at the timing of the first X-ray radiation signal, and subsequently turns on and off the transistors Q2, Q3 complementarily at the input timing of the X-ray radiation signals b. Such operation timings and other details will be described later on.

A graticule signal generator 20 generates a graticule signal a serving as a data collection signal. Based on the graticule signal a, a data collector 21 collects information produced by X-rays that have been emitted by the X-ray tube 16 and have passed through an object. The pulsed X-ray radiation signals b are generated by the X-ray radiation controller 22 at the timing of the graticule signal a. The pulse duration and repetitive period of the pulsed X-ray radiation signals b are controlled by a scan controller 23.

Bleeder resistors ra, rb, rc, rd are connected in series with each other and parallel to the X-ray tube 16. The series-connected arrangement of the bleeder resistors ra, rb, rc, rd has a midpoint connected to ground. The junctions between the registers ra, rb and between the resistors rc, rd are coupled to the input terminals, respectively, of a comparison amplifier AMP, which applies an output to a switching control circuit CONT that produces an output for controlling the conduction time of the switching transistor Ql. More specifically, the voltage applied to the X-ray tube 16 is detected by the bleeder resistors, and the detected voltage is applied to the comparison amplifier AMP. Based on the compared output from the comparison amplifier AMP, the switching control circuit CONT controls the conduction time of the transistor Ql, for thereby optimizing the voltage applied to the X-ray tube 16 (negative feedback control).

Figure 5:
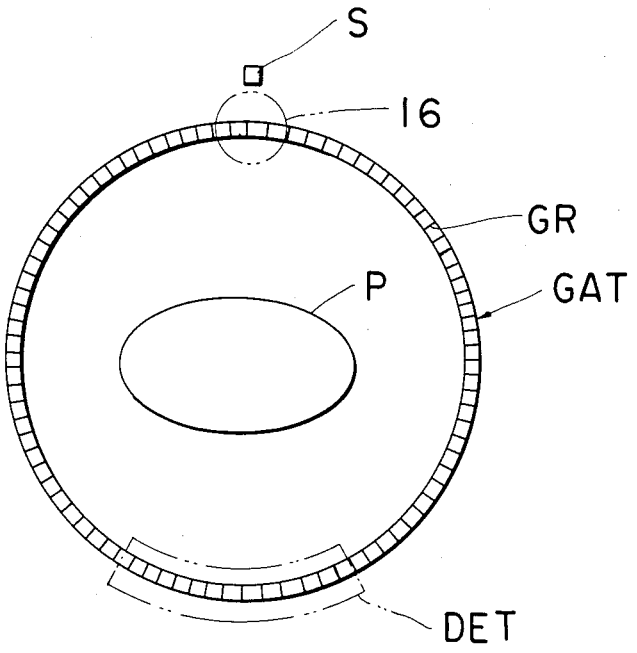
FIG. 5 is a schematic view of a graticule signal generator shown in FIG. 1.

As illustrated in FIG. 5, the graticule signal generator 20 includes a rotor GAT supporting the X-ray tube 16 and a detector DET at diametrically opposite positions in confronting relation to each other with an object B therebetween. The rotor GAT has linear marks or graticule lines GR marked at equal intervals circumferentially therealong. The graticule signal a is produced as a pulsed signal by the detector S which detects the linear marks GR.

Figure 2:
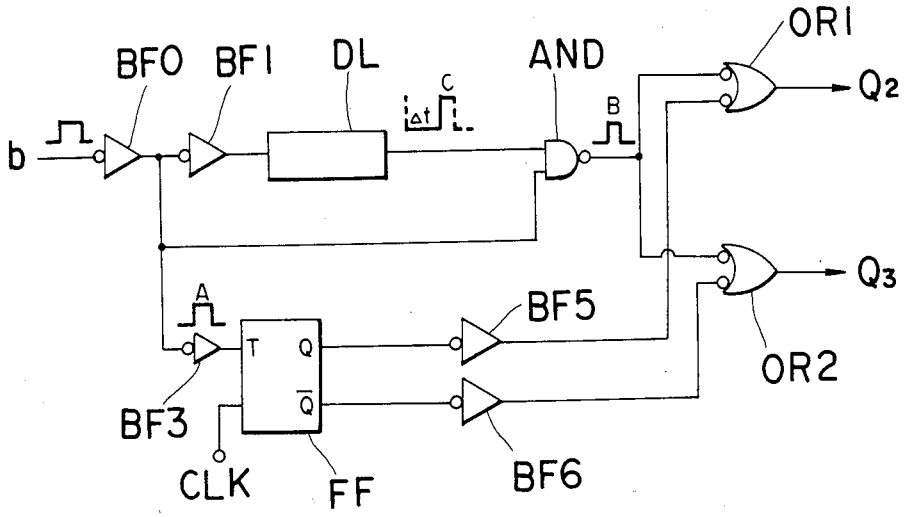
FIG. 2 is a block diagram of a logic circuit as an inverter controller shown in FIG. 1.

FIG. 2 shows a circuit arrangement of the inverter controller 17, by way of example. The inverter controller 17 includes buffers BF0, BF1 for transmitting the X-ray radiation signals b, a delay circuit DL for delaying an output signal from the buffer BF1, an AND gate AND for receiving as two input signals an output signal from the delay circuit DL and an output signal from the buffer BF0, a T flip-flop FF having a trigger terminal supplied with the X-ray radiation signals b through the buffer BF0 and a buffer BF3 and a clock terminal supplied with a clock signal CLK, and a pair of buffers BF5, BF6 coupled respectively to the output terminals Q, $\overline{Q}$ of the T flip-flop FF. The buffers BF5, BF6 have output terminals connected to input terminals of OR gates OR1, OR2, respectively, which have other input terminals connected to the output terminal of the AND gate AND. The OR gates OR1, OR2 have their output terminals joined to the respective bases of the transistors Q2, Q3.

Operation of the X-ray generator system 10 thus constructed will be described with reference to FIGS. 3 and 4.

The three-phase AC voltages are converted by the rectifying and smoothing circuit 11 into a DC voltage that is applied to and regulated by the DC voltage regulator 12. The DC voltage which is regulated to a prescribed voltage value by the switching operation of the transistor Q1 of the DC voltage regulator 12 is applied to the inverter 13, whereupon the X-ray generator system 10 waits for X-ray radiation signals b from the X-ray radiation controller 22.

When a graticule signal a is applied by the graticule signal generator 20 to the X-ray radiation controller 22, the X-ray radiation controller 22 produces X-ray radiation signals b at the input timing of the graticule signal a and issues them to the inverter controller 17. During the period of time in which the first X-ray radiation signal b1 is generated, the output terminals Q, $\overline{Q}$ of the T flip-flop FF produce complementary signals for enabling the transistors Q2, Q3 to effect complementary switching. Then, the delay circuit DL produces a radiation preparation signal c having a positive-going edge which is delayed by a time $\Delta t$ from the positive-going edge of the first X-ray radiation signal b1. The output signal c from the delay circuit DL is applied to one of the input terminals of the AND gate AND. The other input terminal of the AND gate AND is supplied with such an input signal such that the AND gate AND will remain enabled until the next X-ray radiation signal b2 is applied. Therefore, the output terminal of the AND gate AND produces a control signal B. When the next X-ray radiation signal b2 arrives, the AND gate AND is disabled. The control signal B controls the transistors Q2, Q3 so as to be conducted simultaneously (B mode control) as shown in FIG 4. Thereafter, while the next X-ray radiation signal is being applied, the T flip-flop FF is operated by a signal A to produce complementary signals at the respective output terminals Q, $\overline{Q}$ thereof, for thereby allowing the transistors Q2, Q3 to operate in the complementary fashion (A mode control). The B mode control and the A mode control will subsequently be repeated.

During the B mode control, no high voltage is induced across the secondaries **14*b*, 14*c* of the transformer 14 since mutually reverse currents flow in the primary 14*a*** on opposite sides of the central tap thereof.

According to the A mode control, a high voltage is generated across the secondary **14*b* of the transformer 14 and applied through the second rectifying and smoothing circuit 15 to the X-ray tube 16, which generates X-rays. The period of time in which the X-rays are emitted is determined by the pulse duration of the X-ray radiation signal b because the transistors Q2, Q3 continue to complementarily turn on and off during the high-level interval of the X-ray radiation signal b. Cycles of the B and A modes are repeated as long as the graticule signal a is generated at a constant period, with the result that pulsed X-rays are produced by the X-ray tube 16**.

Figure 3:
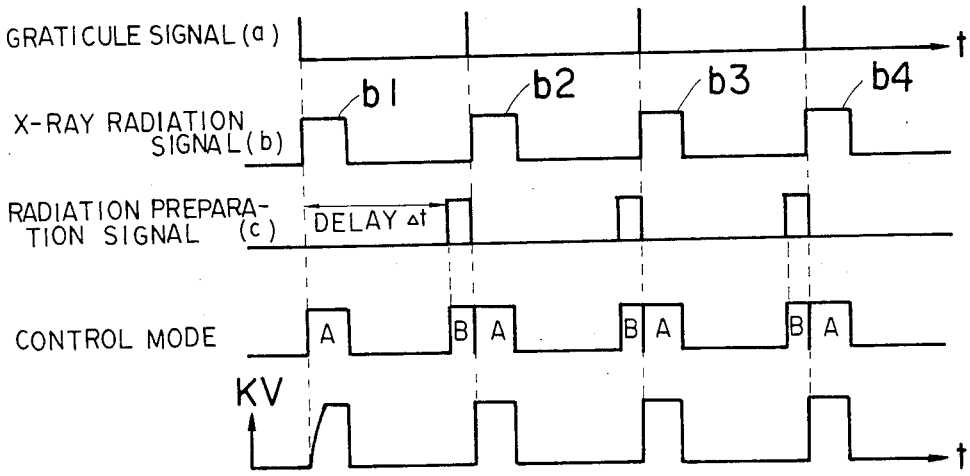
FIGS. 3 and 4 are timing charts of operation of the X-ray generator system illustrated in FIG. 1.
Figure 4:
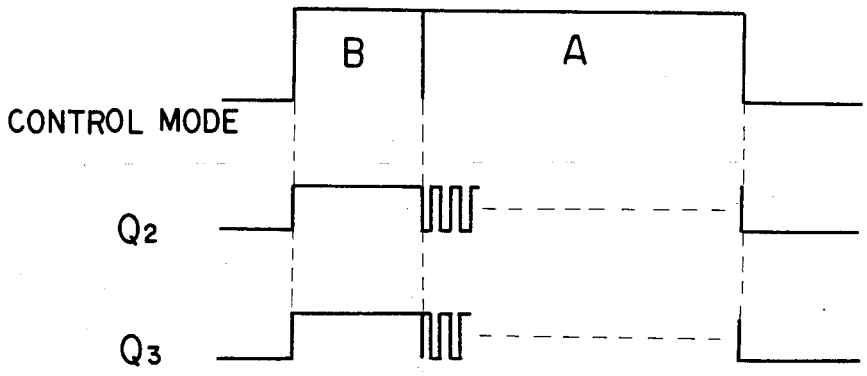

As shown in FIG. 3, the tube voltage KV (the output from the second rectifying and smoothing circuit 15) produced in response to the first X-ray radiation signal b1 has a positive-going edge which is relatively less sharp (i.e., the pulse rise time is long) as with the conventional X-ray generator systems since no B mode control is effected (the transistors Q2, Q3 are not simultaneously turned on). However, the tube voltages KV produced in response to the successive X-ray radiation signals b2, b3, b4, . . . have positive-going edges rising sharply (i.e., the pulse rise time is short) in as much as a sufficient current flows in advance through the coil L3 and the primary **14*a* during B mode control. These tube voltages KV have substantially rectangular waveforms. By applying such tube voltages to the X-ray tube 16, the X-ray tube 16** can emit stable pulsed X-ray radiation. It is better not to employ the tube voltage produced in response to the first X-ray radiation signal b1 for the collection of data since the rising characteristics of that tube voltage are poor.

With the arrangement of the present invention, as described above, the X-ray generator system 10 has a control mode (B mode) for simultaneously turned on the transistors Q2, Q3 immediately before they start to be complementarily turned on and off, so that the tube voltages will have positive-going edges which rise sharply. Such improved rising characteristics of the tube voltages enable the X-ray tube 16 to emit stable pulsed X-ray radiation for thereby improving the quality of CT images reconstructed on the X-ray CT scanning apparatus.

While in the illustrated embodiment a radiation preparation signal is generated on the basis of the first X-ray radiation signal b1 for effecting B mode control, the transistors Q1, Q2 may first be turned on (B mode) at the timing of the positive-going edges of the X-ray radiation signals b1, b2, b3, b4, . . . , and thereafter the transistors Q1, Q2 may be complementarily turned on and off (A mode) at the normal switching frequency. In such a case, the X-ray radiation timing in the X-ray CT scanning apparatus may be delayed for the period of B mode control, but such a delay can be compensated for when the image will be reconstructed.

The first and second switching means Q2, Q3 may comprise other switching devices such as SCRs (silicon-controlled rectifiers) or GTO (gate turn-off) SCR, than the transistors. The X-ray generator system 10 of the present invention may be incorporated in other apparatus than the X-ray CT scanning apparatus.

Although a certain preferred embodiment has been shown and described, it should be understood that many changes and modifications may be made therein without departing from the scope of the appended claims.

I claim:

1. An X-ray generator system comprising:

an X-ray source for generating X-rays;

inverter means, having a transformer with primary and secondary windings and a central tap on said primary windings, a coil coupled to said central tap, and first and second switch devices coupled to opposite ends of said primary winding, for generating a high voltage across said secondary winding for the generation of said X-rays in response to intermittent application of a DC voltage through said coil to said primary winding by complementary turning on and off said first and second switching devices; and inverter controller means for repeatedly and complementarily turning on and off said first and second switching devices during periodic intervals, for simultaneously turning on said first and second switching devices immediately before said periodic intervals for a predetermined time less than the time between said periodic intervals, and for maintaining both said first and second switching devices turning off from the end of said periodic intervals until the start of a subsequent one of said predetermined times.

2. An X-ray generator system according to claim 1, wherein said inverter controller means includes a delay circuit for delaying an X-ray radiation signal for a predetermined period of time, a logic gate supplied with an output signal from delay circuit and the X-ray radiation signal, and a flip-flop for generating two complementarily variable output signals in response to the X-ray radiation signal.

3. An X-ray generator system according to claim 1, wherein said first and second switching devices comprise transistors, respectively, coupled to the opposite ends of said primary winding.

* * * * *

UNITED STATES PATENT AND TRADEMARK OFFICE

CERTIFICATE OF CORRECTION

PATENT NO. : 4,783,795

DATED : November 8, 1988

INVENTOR(S) : Mitsuru Yahata

It is certified that error appears in the above-identified patent and that said Letters Patent is hereby corrected as shown below:

At [73], change "Assignee: Kabushikigaisha Toshiba, Kanagawa, Japan"

to --Assignee: Kabushiki Kaisha Toshiba, Kanagawa-Ken Japan--.

Signed and Sealed this

First Day of August, 1989

*Attest:*

*Attesting Officer*

DONALD J. QUIGG

*Commissioner of Patents and Trademarks*